US005300010A

United States Patent [19]

Eddins

[11] Patent Number: 5,300,010

[45] Date of Patent: Apr. 5, 1994

[54] METHOD AND APPARATUS FOR MAKING ARTIFICIAL FLOWERS

[75] Inventor: Fred D. Eddins, Mapleville, R.I.

[73] Assignee: Hasbro, Inc., Pawtucket, R.I.

[21] Appl. No.: 962,741

[22] Filed: Oct. 19, 1992

[51] Int. Cl.[5] ..... A41G 1/02; B31D 5/04; B65H 45/04; B65H 45/06

[52] U.S. Cl. ..... 493/379; 493/381; 493/388; 493/416; 493/454; 493/956

[58] Field of Search ..... 493/359, 379, 380, 381, 493/386, 388, 413, 414, 416, 434, 436, 454, 956, 957, 958

[56] References Cited

U.S. PATENT DOCUMENTS

| | | | |
|---|---|---|---|
| 2,157,583 | 5/1939 | Wisoff | 493/957 |
| 2,568,495 | 9/1951 | Goodwin | 493/957 |
| 2,994,252 | 8/1961 | Lalick | 493/956 |
| 3,059,366 | 10/1962 | Kafka et al. | 493/956 |
| 3,330,103 | 7/1967 | Rodermund et al. | 493/958 |
| 3,453,170 | 7/1969 | Jason | 483/958 |
| 3,484,329 | 12/1969 | Boisse | 493/958 |
| 4,661,197 | 4/1987 | Mancel et al. | 493/955 |
| 4,708,893 | 11/1987 | Little et al. | 156/61 |
| 4,892,515 | 1/1990 | Stiegeler | 493/956 |
| 5,091,226 | 2/1992 | Protz | 493/958 |

FOREIGN PATENT DOCUMENTS

| | | | |
|---|---|---|---|
| 1322314 | 7/1973 | United Kingdom | 493/958 |
| 1346849 | 2/1974 | United Kingdom | 493/956 |

*Primary Examiner*—William E. Terrell
*Attorney, Agent, or Firm*—Salter, Michaelson & Benson

[57] ABSTRACT

A mechanical apparatus and method for producing a folded paper rose from an elongated strip of paper. The apparatus is operated by feeding an elongated paper strip through a rotating shuttle assembly, and securing the end of the paper strip onto a slotted stem which is rotated simultaneously with the shuttle assembly. Rotating the shuttle assembly causes a pair of shuttles to cooperate with a paper folding member adjacent the ends of the shuttles to produce a series of sequential folds in the paper strip. Meanwhile, the stem is simultaneously rotating to assemble the folded paper around the stem. Once the paper is fully assembled around the stem the folded paper strip is compressed toward the top of the stem to form a compact flower assembly at the end of the stem.

10 Claims, 4 Drawing Sheets

METHOD AND APPARATUS FOR MAKING ARTIFICIAL FLOWERS

BACKGROUND OF THE INVENTION

The instant invention relates to artificial flowers and more specifically relates to a method and apparatus for producing a folded paper flower which resembles a rose.

Apparatus for producing various types of twisted bows and ornaments have heretofore been known in the art. For example, such apparatus are disclosed in the Cotton U.S. Pat. No. 1,728,724; Napier U.S. Pat. No. 3,129,861; Goldfarb U.S. Pat. No. 3,225,976; West U.S. Pat. No. 3,553,061; Mancel et al U.S. Pat. No. 4,661,197; Raiskums et al U.S. Pat. No. 4,840,689; and Mancel et al U.S. Pat. No. 4,855,009, which are believed to be of general interest with respect to the subject invention.

Apparatus for producing artificial flowers, and in particular fabric roses, have also been known in the art. In this regard the Little et al U.S. Pat. No. 4,708,893 which represents the closest prior art to the subject invention of which the applicant is aware discloses a method and apparatus for producing fabric roses for garment applications. The method disclosed in this patent involves inserting a fabric ribbon between two needle-like devices which are adapted to hold the ribbon. The needle-like devices are then rotated by means of a variable speed motor to rotate the fabric. As the fabric is rotated, the center of a rose is formed and then the petals of the rose are formed by folding the ribbon numerous times in a direction away from the needle-like devices. Once the rose has been completed, it is removed from the needle-like device, and it is finished by heat sealing the portions of the ribbon which form the base of the rose.

SUMMARY OF THE INVENTION

The instant invention provides a method and apparatus for producing a folded paper rose from an elongated strip of paper.

Briefly, the apparatus comprises a housing, a rotating shuttle assembly mounted in the housing, and a stem-rotating assembly adjacent the end of the shuttle assembly. The housing is formed to include an integral paper folding member which is also located adjacent the end of the shuttle assembly. The shuttle assembly includes a shuttle body and a pair of reciprocating shuttles which alternately extend outwardly toward the paper folding member as the shuttle assembly is rotated. The stem-rotating assembly comprises a pair of gears which are operative for rotating a slotted stem about an axis which is substantially perpendicular to the axis of rotation of the shuttle assembly. The shuttle assembly further includes a ring gear which intermeshes with the stem-rotating gears so that the stem is simultaneously rotated with the shuttle assembly. The apparatus is operative by feeding an elongated paper strip between the shuttles, securing the paper strip in the slot which is located adjacent one end of the stem, and rotating the shuttle assembly so that alternating shuttles advance the paper strip as they are reciprocated, and so that the shuttles cooperate with the paper folding member to produce a series of sequential folds of approximately 90° each in the advancing paper. The stem is simultaneously rotated so that the folded paper is assembled around the stem in a predetermined arrangement immediately after it has been folded by the shuttles. The folded paper is then compressed along the axis of the stem to form a compact flower assembly at the end of the stem.

Accordingly, it is an object of the subject invention to provide an apparatus for producing a series of sequential folds in an elongated strip of paper to form a paper flower.

It is another object of the instant invention to provide an apparatus for producing a folded paper rose from an elongated strip of paper.

It is yet another object of the subject invention to provide a method and apparatus for producing a folded paper rose by rotating and folding an elongated paper strip in a series of sequential folds and assembling the folded paper strip on a rotating stem.

It is still another object of the subject invention to provide an apparatus which can be operated by a child to produce a folded paper rose.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
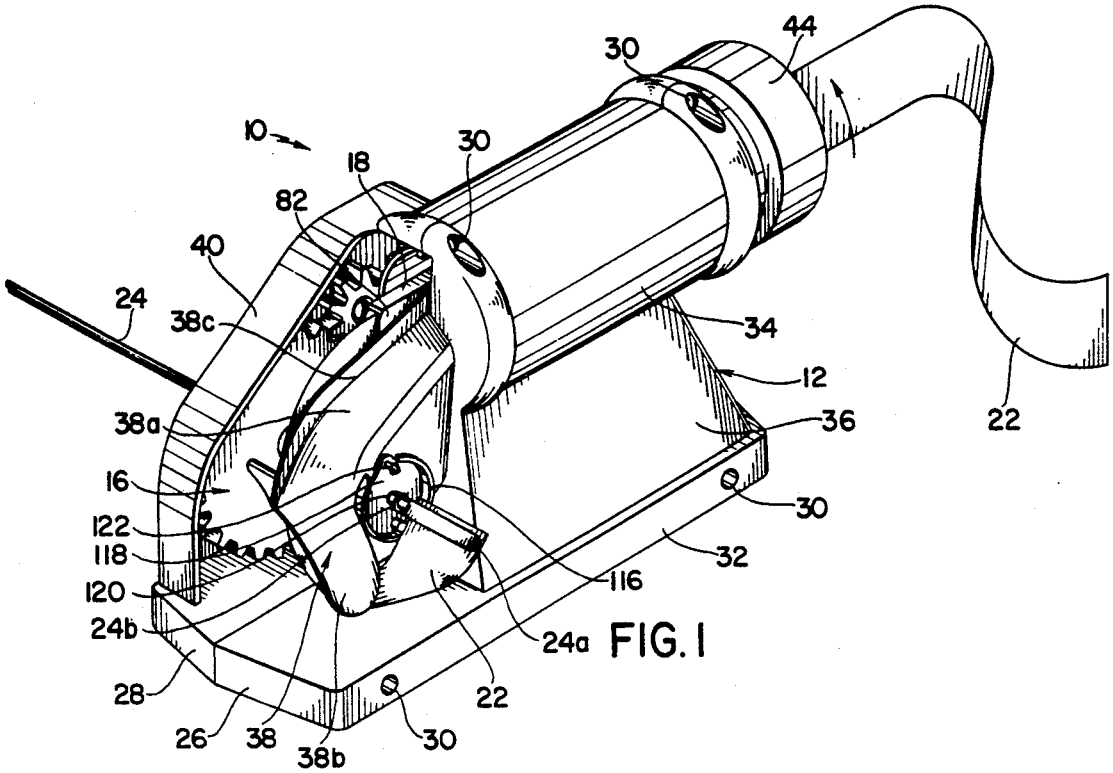
FIG. 1 is a perspective view of the apparatus of the instant invention with a paper strip inserted therein.
Figure 2:
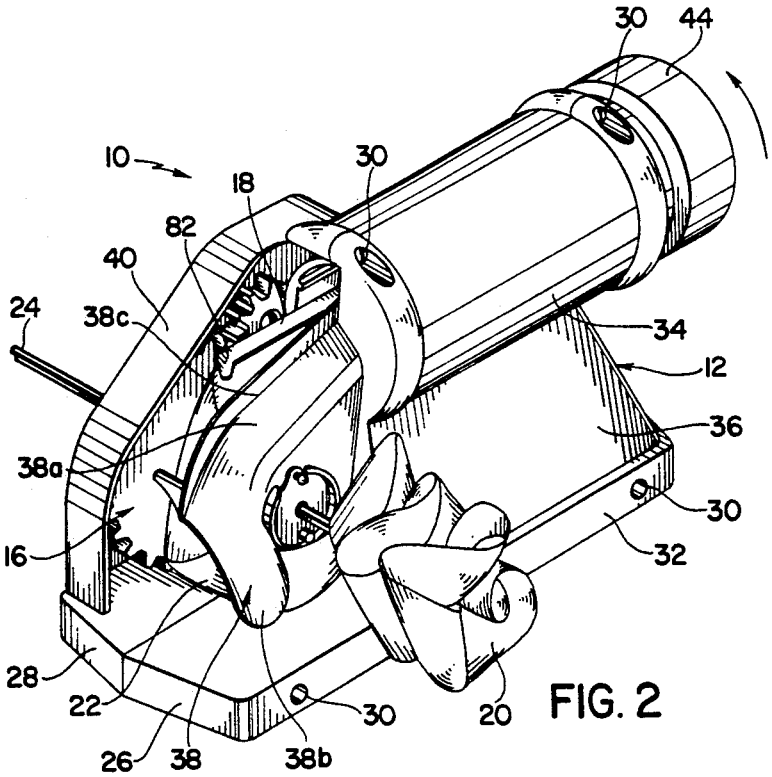
FIG. 2 is another perspective view thereof with the paper strip partially folded into a paper rose.

Referring now to the drawings, the rose-making apparatus of the instant invention is illustrated and generally indicated at 10 in FIGS. 1 and 2. The rose-making apparatus 10, which is operative in accordance with the method of the subject invention comprises a housing generally indicated at. 12, a rotating shuttle assembly generally indicated at 14 (FIG. 4), and a stem-rotating assembly generally indicated at 16. The shuttle assembly 14 includes a pair of reciprocating shuttles 18 which alternately extend and retract therefrom. As illustrated in FIGS. 1 and 2, the rose-making apparatus 10 is operative in accordance with the method for producing a folded paper rose 20 (FIG. 2) from an elongated paper strip 22 by feeding the paper strip 22 between the shuttles 18, and rotating the shuttle assembly 14 so that the shuttles 18 cooperate to produce a series of sequential folds in the paper 22. The folded paper strip 22 is immediately thereafter assembled onto a stem 24 of noncircular cross section (FIG. 2) which rotates simultaneously with the shuttle assembly 14 to form the folded paper rose 20.

The housing 12 includes first and second housing section halves generally indicated at 26 and 28, respectively, which are received and secured in interfitting engagement with screws 30, so that they cooperate to define a housing for the rotating shuttle assembly 14 and the stem-rotating assembly 16. The housing 12 is formed to include a base portion 32 for supporting the apparatus 10 on a supporting surface, a tubular portion 34 for housing the rotatable shuttle assembly 14, and a pedestal portion 36 for supporting the tubular portion 34 above the base portion 32. The first housing section half 26 is further formed to include a paper folding member generally indicated at 38 adjacent the ends of the shuttles 18. The paper folding member includes a body portion **38*a* which extends outwardly and downwardly from the front of the housing, and a guide arm portion 38*b* which extends outwardly and downwardly to the side of the body portion 38*a*. The body portion 38*a* includes a folding edge 38*c* which lies generally coextensive with the forward edge portions of the shuttles 18 when they are extended outwardly. The paper folding member 38 cooperates with the shuttles 18 to fold the paper strip 22 as it is passed therebetween. The second housing section half 28 is further formed to include a gear casing 40 which carries the gears of the stem-rotating assembly 16**.

Figure 4:
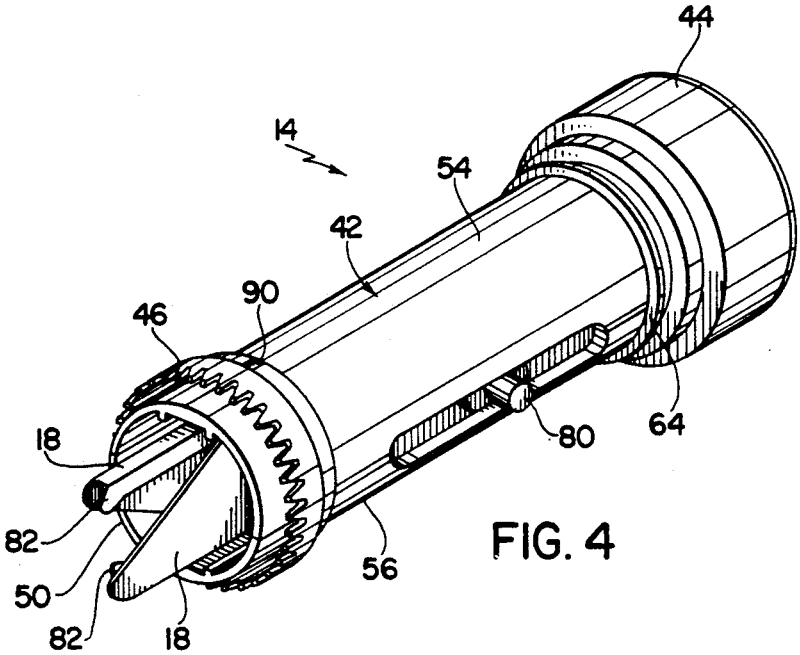
FIG. 4 is a perspective view of the rotating shuttle assembly.
Figure 5:
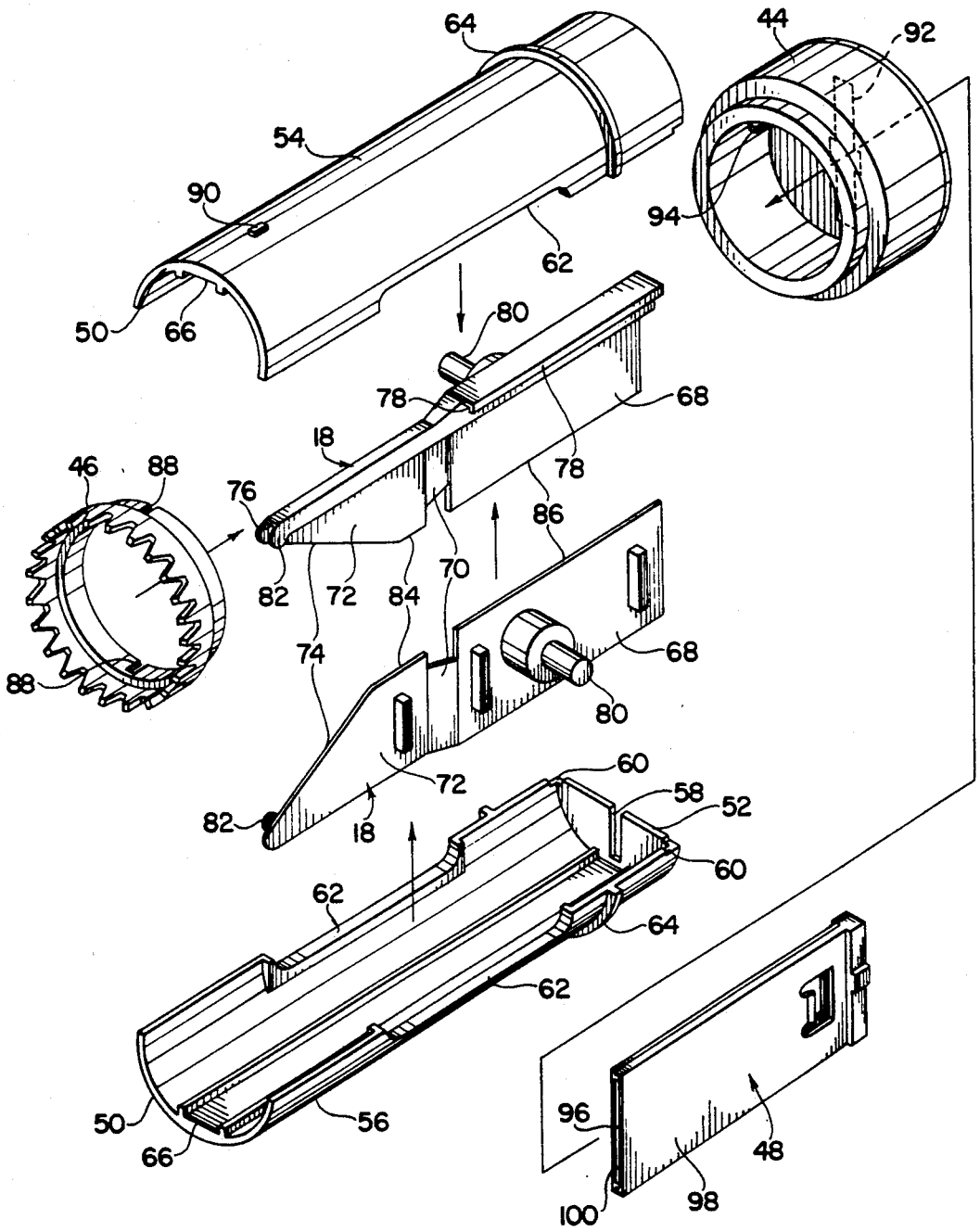
FIG. 5 is an exploded perspective view thereof.

Referring now to FIGS. 4 and 5, the rotatable shuttle assembly 14 comprises a tubular shuttle body 42, an end cap 44, a ring gear 46, a pair of reciprocating shuttles 18, and a paper guide 48 (FIG. 5). The shuttle body 42 has an open end 50 through which the shuttles 18 protrude, and a closed end 52 over which the end cap 44 is received. The shuttle body 40 includes upper and lower body section halves 54 and 56, respectively, which are received and secured in interfitting engagement so that they cooperate to define a housing for the reciprocating shuttles 18. The upper and lower body section halves 54 and 56, respectively, cooperate to define a vertically extending slot 58 located in the closed end 52 thereof, a pair of notches 60 located adjacent the closed end 52, a pair of elongated longitudinal slots 62 in the sides thereof, and an external flange 64 adjacent the closed end 52. The upper and lower body section halves 54 and 56 are further formed to include internal longitudinal channels 66 in which the shuttles 18 are slidably received for reciprocating motion. The shuttles 18 are formed identically and each includes a rear body section 68, an angular neck section 70, and a tapered head section 72. Each of the shuttle heads 72 includes a paper folding edge 74 which is disposed at an angle of approximately 45° to the longitudinal extent of the shuttle head 72 thereof and which cooperates with the paper folding member 38 to fold the paper strip 22 as it is passed therebetween. The shuttles 18 are further formed to include inner and outer channel sections 76 and 78, respectively, along the bottom edges thereof, and cam shafts 80 which extend outwardly from the shuttle body 42 through the longitudinal slots 62 in the sides thereof. The inner channel sections 76 are each formed to include a grasping clip 82 at the front portion thereof which grasps the paper strip 22 at the edge of the immediately preceeding sequential paper fold to advance the paper strip through the shuttle assembly 14. When the shuttles 18 are assembled together in sliding relation, the top edge portions 84 of the head sections 72 slide in the inner channels 76 of the opposing shuttles, while the top edge portions 86 of the body sections 68 slide in the outer channels 78 of the opposing shuttles. In assembled relation, the head sections 72 are disposed in closely spaced face-to-face relation, while the body sections 68 are maintained in spaced apart relation. The ring gear 46 is slidably received around the open end 50 of the shuttle body 42, and it is maintained in position by a pair of notches 88 therein which are received in engagement with a pair of corresponding tabs 90 on the outside surface of the shuttle body 42. The end cap 44 is formed to include a vertical notched slot 92 (shown in broken lines in FIG. 5) and it is slidably received around the closed end 52 of the shuttle body 42 where it is maintained in position by a pair of tabs 94 (only one shown) on the inside surface thereof which are received in engagement with the corresponding notches 60 in the shuttle body 42. The paper guide 48 comprises identical left and right guide section halves 96 and 98, respectively, which are received and secured in interfitting engagement so that they cooperate to define a vertical paper guide channel 100 extending therebetween. The paper guide 48 extends through the slot 92 in the end cap 42, through the slot 58 in the shuttle body 40, and between the spaced body sections 68 of the shuttles 18.

Figure 3:
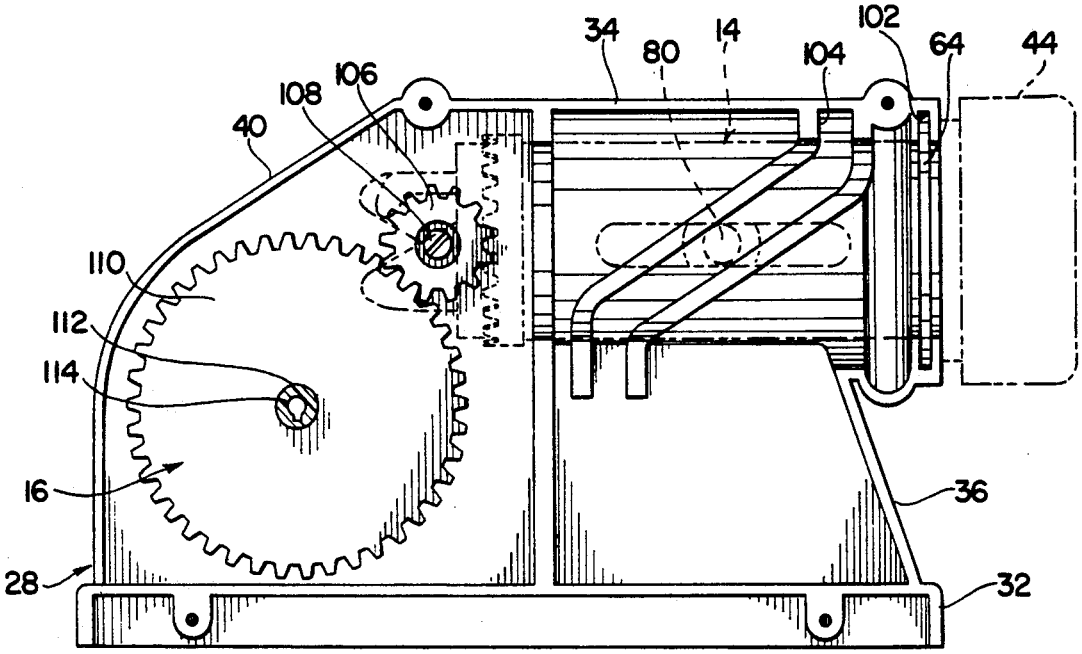
FIG. 3 is a side view of the rear housing section of the apparatus with the rotating shuttle assembly illustrated in broken lines.

As illustrated in FIG. 3, the shuttle assembly 14 (shown in broken lines) is rotatably received in the tubular portion 34 of the housing 12 so that the end cap 44 projects outwardly adjacent one end thereof, and so that the ring gear 46 is disposed adjacent the opposite end thereof between the gear casing 40 and the paper folding member 38 (not shown in FIG. 3). The head portions 72 of the shuttles 18 are reciprocatable adjacent to the paper folding member 38. The tubular portions 34 of the first and second housing section halves 26 and 28, respectively, cooperate to define a retaining channel 102 at the outer ends of the tubular portions 34. The channel 102 receives the flange 64 of the shuttle body 42 to maintain the shuttle assembly 14 in position in the housing 12. The tubular portions 34 of the first and second housing section halves 26 and 28 further cooperate to define a continuous cam channel 104 which extends between the lower forward portions of the assembled tubular portions 34 and the upper rearward portions thereof around the entire inner surface of the shuttle body 42. The cam channel 104 slidably receives the cam shafts 80 which extend outwardly from the sides of the shuttle assembly 14. The shuttle assembly 14 is rotatable in the tubular portion 34 by manually turning the end cap 44. Rotation of the shuttle assembly 14 causes the cam shafts 80 to travel within the cam channel 104 so that the shuttles 18 are alternately moved between outwardly or forwardly extended positions and inwardly retracted positions in the shuttle assembly 14.

The stem-rotating assembly 16 includes a drive gear 106 which is mounted in the gear casing 40 by a screw 108 so that it intermeshes with the adjacent ring gear 46 of the shuttle assembly 14. The stem-rotating assembly 16 further includes a transmission gear 110 which intermeshes with the drive gear 106. The transmission gear 110 has an elongated shaft 112 which extends between the gear casing 40 and the paper folding member 38. The shaft 112 includes a slotted bore 114 which is formed to nonrotatably receive the stem 24. The shaft 112 is rotatably received between apertures (not shown) in the gear casing 40, and in the paper folding member 38 so that the stem 24 may be extended completely through the housing as illustrated in FIGS. 1 and 2. Rotation of the shuttle assembly 14 and the planetary gear 46 causes a simultaneous rotation of the intermeshing gears 106 and 110 so that the shuttle assembly 14 and the stem 24 rotate together.

Figure 6:
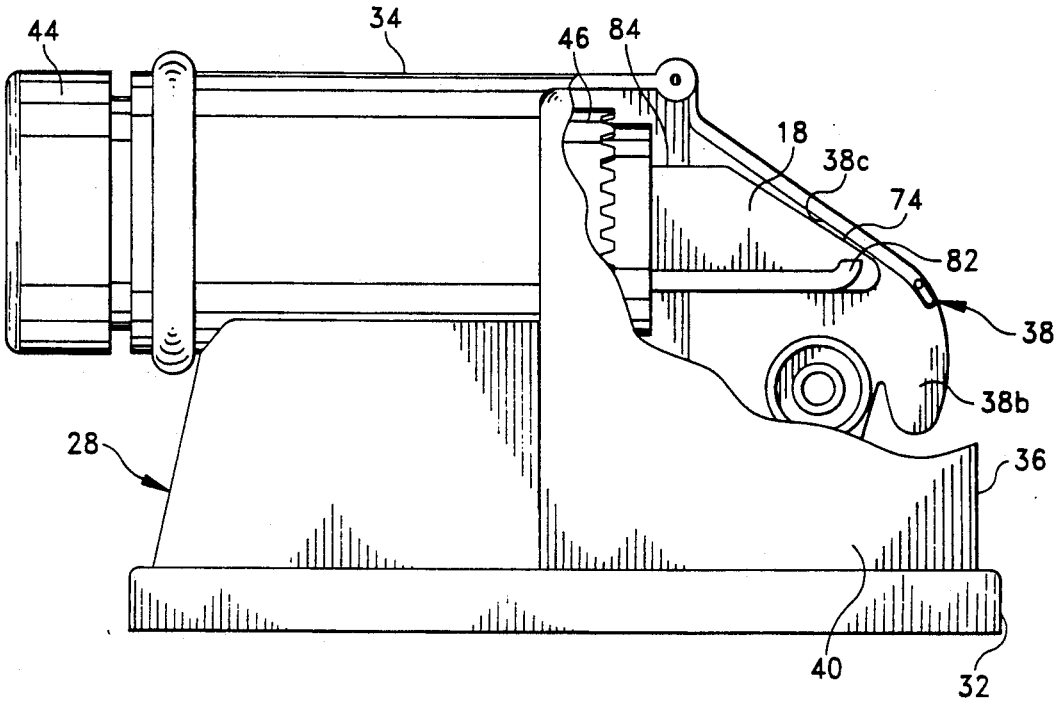
FIG. 6 is an elevational view partially cut away to show the cooperation of the shuttle members and the paper folding member.
Figure 7:
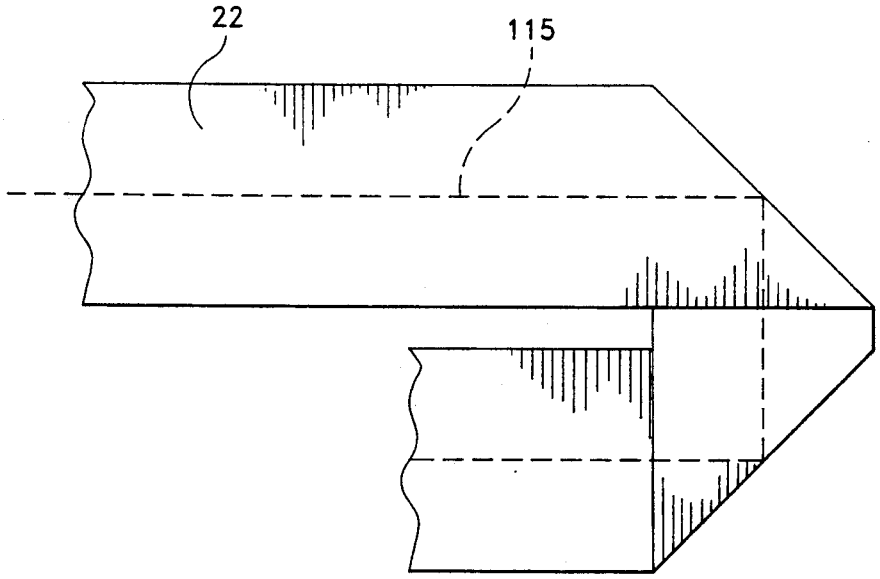
FIG. 7 is an elevational view of the paper strip with two folds formed therein.

The apparatus 10 is operated by assembling a stem 24 in the bore 114 so that the slotted terminal end portion of the stem 24 projects outwardly from the bore 114 adjacent the paper folding member 38, feeding an elongated paper strip 22 between the shuttles 18 and securing the terminal end of the paper strip 22 in the slot 24a adjacent the terminal end of the stem 24. More specifically, the paper strip 22 is threaded into the paper guide 48 in the end cap 44 and through the paper guide channel 100, which guides the paper 22 between the shuttles 18. The paper strip 22 is assembled so that it extends between the grasping clips 82 at the ends of the shuttles and under the paper folding member 38, and it is secured in the slot in the stem 24. The shuttle assembly 14 is then rotated to cause the shuttles 18 to rotate and reciprocate so that they alternately extend toward the paper folding member 38, whereby the shuttles 18 and the paper folding member 38 cooperate to produce a series of sequential folds of approximately 90° each in the paper strip 22. In operation, as each shuttle 18 is retracted and then advanced, the grasping clip 82 thereof grasps the edge of the paper strip 22 adjacent the last fold therein and advances the strip 22 forwardly with the shuttle 18 as the shuttle 18 is advanced toward the paper folding member 38. When the shuttle 18 is completely extended so that it is adjacent the paper folding member 38, further rotation of the shuttle 18 causes the paper folding edge 74 to cooperate with the folding edge 38c (see FIG. 6) to produce a fold of approximately 90° in the paper strip 22, i.e. the paper strip 22 is folded over on itself in a direction substantially perpendicular to a longitudinal centerline 115 of the strip 22 (see FIG. 7). Further, as rotation of the shuttle assembly 14 is continued the extended shuttle 18 is retracted, and the other shuttle 18 grasps the paper strip 22 in a similar manner to further advance the paper strip 22 forward toward the paper folding member 38 and to produce another fold therein. Accordingly two such folds are produced for every 360° rotation of the shuttle assembly 14. As the folded portions of the paper strip 22 are advanced forwardly, they are guided downwardly by the guide arm 38b so that they are in the proper position for assembly onto the rotating stem. In this manner, as the shuttle assembly 14 is rotated the stem 24 is simultaneously rotated so that the folded paper strip 22 is assembled around the stem 24 in a continuous spiral as illustrated in FIG. 2.

It can be seen from FIG. 2 that the housing 12 further includes a circular ridge 116 which projects outwardly from the outside surface of the paper folding member 38, and encircles the aperture where the stem 24 is received in the shaft 112 of the transmission gear 110. The ridge 116 is formed so that it is operative for retaining a circular disk 118 therein which includes a central aperture 120 and a short pointed pin 122. In use, the stem 24 is assembled in the bore 114 so that it passes through the central aperture 120. When the folded paper strip has been completely assembled around the stem 24, the disk 118 is moved outwardly slightly on the stem to retain the rose in a fully assembled position thereon. In this regard, as the disk 118 is moved forwardly, the central aperture 120 is forced past a shoulder 24b on the stem 24 so that the disk 118 is then prevented from moving rearwardly on the stem. Further, as the disk 118 is advanced forwardly on the stem 24 in this manner the pointed pin 122 penetrates the terminal end portion of the paper strip 22 to prevent the folded paper rose from becoming unwound from the stem 24. The stem 24 is thereafter removed from the apparatus 10 and the procedure can be repeated to form another folded paper rose.

Accordingly, the method for forming a folded paper flower comprises the steps of longitudinally advancing an elongated paper strip to a folding station, sequentially folding the paper strip over onto itself in a predetermined fashion, rotating a stem adjacent the folding station wherein the paper strip is securable to the stem, guiding the sequential folded portions onto the stem, and retaining the folded portions thereon so that they are assembled in a flower-like configuration. More specifically, the paper strip is sequentially folded over on itself in a predetermined direction at intervals corresponding to the width of the strip and at angles of 90°. When the folded portions are guided onto the stem, they are positioned in substantially perpendicular relation to the stem.

It can be seen therefore that the instant invention provides effective apparatus and method for producing a folded paper rose from an elongated strip of paper. The shuttle assembly 14 is rotatable so that the individual shuttles 18 cooperate with the paper folding member 38 to produce a series of sequential folds in the paper strip 22. The stem 24 is mechanically connected to the shuttle so that it is simultaneously rotated to assemble the folded paper around the stem 24. When the paper has been completely folded in this manner a retaining disk 122 can be assembled therewith to secure the folded paper rose 20 from unwinding from the stem 24. Accordingly, it is seen that the apparatus 10 is simple to use, and allows anyone to easily produce a complicated folded paper rose 20. Hence, it is believed that the flower-making apparatus 10 of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for forming a folded paper flower comprising:

a housing including a paper folding member;

means for longitudinally advancing an elongated paper strip to said paper folding member, said paper strip having a width and a longitudinal centerline;

means cooperating with said paper folding member for sequentially folding said paper strip over on itself in a predetermined direction substantially perpendicular to said longitudinal centerline, said paper strip being sequentially folded at intervals corresponding approximately to said width;

means for rotating a stem adjacent said paper folding member, said paper strip being securable to said stem adjacent one end of said stem;

means on said paper folding member for guiding said strip onto said rotating stem so that said folded portions are assembled around said stem in a continuous spiral configuration, said folded portions being retainable on said stem adjacent said one end of said stem so that said folded portions simulate the appearance of a flower.

2. In the apparatus of claim 1, said means for sequentially folding said paper strip comprising rotatable shuttle means including a pair of shuttle members, means for reciprocating said shuttle members in said rotatable shuttle means, and means for simultaneously rotating said shuttle means as said shuttle members are reciprocated, said shuttle members each including an angular paper folding edge at the terminal end thereof, said paper folding edges cooperating with said paper folding member as said shuttle members are longitudinally reciprocated and rotated so as to form said folded portions in said paper strip.

3. In the apparatus of claim 2, said means for longitudinally advancing said paper strip comprising a grasping clip at said terminal end of each of said shuttle members for grasping said paper strip at said folded portions.

4. In the apparatus of claim 2, said angular paper folding edge being disposed at approximately a 45° angle to the longitudinal extent of said shuttle member.

5. The apparatus of claim 2 further comprising cam means for reciprocating said shuttle members.

6. In the apparatus of claim 2, said rotatable shuttle means including gear means, said means for rotating said stem comprising stem gear means, said stem gear means intermeshing with said shuttle gear means wherein rotation of said shuttle means causes simultaneous rotation of said stem.

7. In the apparatus of claim 1, said means for rotating said stem comprising gear means.

8. A method of forming a folded paper flower comprising the steps of:

longitudinally advancing an elongated paper strip to a folding station;

sequentially folding said paper strip over on itself in a predetermined direction which is substantially perpendicular to a longitudinal centerline of said paper strip, said paper strip being folded at intervals corresponding approximately to a width of said paper strip;

rotating a stem adjacent said folding station, said paper strip being securable to said stem adjacent one end of said stem;

guiding said strip so that said folded portions are assembled around said stem in a continuous spiral configuration; and retaining said paper strip on said stem adjacent said one end of said stem so that said folded portions simulate the appearance of a flower.

9. An apparatus for forming a folded paper flower comprising:

means for longitudinally advancing an elongated paper strip to a folding station, said paper strip having a width and a longitudinal centerline;

means at said folding station for sequentially folding said paper strip over on itself in a predetermined direction so that successive leading portions of said strip extend substantially perpendicular to said longitudinal centerline, said paper strip being sequentially folded at intervals corresponding approximately to said width;

means for rotating a stem adjacent said paper folding station, said paper strip being securable to said stem adjacent one end of said stem;

means for guiding said strip onto said rotating stem so that said folded portions are assembled around said stem in a continuous spiral configuration, said folded portions being retainable on said stem adjacent said one of said stem so that said folded portions simulate the appearance of a flower.

10. An apparatus for forming a folded paper flower comprising:

a housing including a paper folding member;

a pair of sliding shuttle members mounted in said housing;

means for simultaneously rotating and longitudinally reciprocating said shuttle members, said pair of shuttle members being operable for longitudinally advancing an elongated strip of paper to said folding member and for simultaneously rotating said paper strip, said paper strip having a width and a longitudinal centerline, said shuttle members cooperating with said paper folding member for sequentially folding said paper strip over on itself in a predetermined direction substantially perpendicular to said longitudinal centerline, said paper strip being sequentially folded at intervals corresponding approximately to said width;

means for rotating a stem adjacent said paper folding member, said paper strip being securable to said stem adjacent one end of said stem;

a guide arm on said paper folding member for guiding said strip onto said rotating stem so that said folded portions are assembled around said stem in a continuous spiral configuration, said strip being retainable on said stem adjacent said one end of said stem so that said folded portions simulate the appearance of a flower.

* * * * *